US009841162B2

(12) United States Patent
Pickard et al.

(10) Patent No.: US 9,841,162 B2
(45) Date of Patent: Dec. 12, 2017

(54) LIGHTING DEVICE WITH MULTIPLE-REGION REFLECTOR

(75) Inventors: Paul Kenneth Pickard, Morrisville, NC (US); Antony Paul Van De Ven, Hong Kong (CN)

(73) Assignee: Cree, Inc., Durham, NC (US)

( * ) Notice: Subject to any disclaimer, the term of this patent is extended or adjusted under 35 U.S.C. 154(b) by 32 days.

(21) Appl. No.: 12/467,467

(22) Filed: May 18, 2009

(65) Prior Publication Data

US 2010/0290222 A1 Nov. 18, 2010

(51) Int. Cl.

| | |
|---|---|
| ***F21V 7/00*** | (2006.01) |
| ***F21S 8/10*** | (2006.01) |
| ***F21V 7/09*** | (2006.01) |
| *F21W 131/103* | (2006.01) |
| *F21W 131/105* | (2006.01) |

(Continued)

(52) U.S. Cl.

CPC ..... *F21V 7/0008* (2013.01); *F21S 48/1154* (2013.01); *F21S 48/1335* (2013.01); *F21V 7/0025* (2013.01); *F21V 7/09* (2013.01); *F21W 2131/103* (2013.01); *F21W 2131/105* (2013.01);

(Continued)

(58) Field of Classification Search

CPC .... H01L 33/60; H01L 33/642; F21Y 2101/02; F21Y 2103/003; F21Y 2105/001; F21Y 2107/90; F21V 7/0008; F21V 7/0033; F21V 7/005; F21V 7/09; F21V 7/0025; F21V 7/06; F21V 7/08; F21V 7/0016; F21K 9/00; F21K 9/68; F21S 2/00; F21S 48/1154; F21S 48/1335; F21S 48/1388; G09F 9/33; F21W 2131/105; F21W 2131/401; G02B 19/0071

USPC ..... 362/33, 97.1, 97.3, 249.01, 249.02, 362/249.11, 261, 296.01, 296, 297, 302, (Continued)

(56) References Cited

U.S. PATENT DOCUMENTS

| | | | |
|---|---|---|---|
| 4,918,487 | A | 4/1990 | Coulter, Jr. |
| 5,631,190 | A | 5/1997 | Negley |

(Continued)

FOREIGN PATENT DOCUMENTS

| | | | |
|---|---|---|---|
| JP | H06350140 | | 12/1994 |
| WO | 2007/022314 | A2 | 2/2007 |
| WO | 2008/146229 | A2 | 12/2008 |

OTHER PUBLICATIONS

Taiwan Office Action (and translation provided by foreign counsel) from a corresponding Taiwan patent application (TW099111587) dated Mar. 2, 2015, 15 pages.

*Primary Examiner* — Hargobind S Sawhney
(74) *Attorney, Agent, or Firm* — Burr & Brown, PLLC

(57) ABSTRACT

Lighting devices that comprise a light source and a reflector, the reflector comprising first, second and third reflector regions. In some devices, a first portion of light is reflected by the first region and then by the third reflector region, a second portion of light is reflected by the second region and forms a primary beam, and at least 5% of the first portion of light that is reflected by the third region is within the primary beam of light. In some devices, at least 5% of all light reflected by the first reflector region travels from the first reflector region directly to the third reflector region. In some devices, at least 5% of all light reflected by the third reflector region traveled directly from the first reflector region to the third reflector region. In some devices, the reflector comprises means for providing the features described above.

52 Claims, 4 Drawing Sheets

(51) Int. Cl.
*F21W 131/401* (2006.01)
*F21Y 107/90* (2016.01)

(52) U.S. Cl.
CPC .... *F21W 2131/401* (2013.01); *F21Y 2107/90* (2016.08)

(58) Field of Classification Search
USPC ..... 362/303, 310, 311.02, 311.09, 311.11, 362/311.12, 346, 347, 350, 800
See application file for complete search history.

(56) References Cited

U.S. PATENT DOCUMENTS 5,912,477 A 6/1999 Negley
5,924,785 A 7/1999 Zhang et al.
6,149,283 A 11/2000 Conway et al.
6,234,648 B1 5/2001 Borner et al.
6,577,073 B2 6/2003 Shimizu et al.
6,578,998 B2 6/2003 Zhang
6,637,921 B2 10/2003 Coushaine
6,672,741 B1 1/2004 Young
6,692,136 B2 2/2004 Marshall et al.
6,722,777 B2 4/2004 Erber
6,767,112 B2 7/2004 Wu
6,811,277 B2 11/2004 Amano
6,846,101 B2 1/2005 Coushaine
6,851,835 B2 2/2005 Smith et al.
6,893,140 B2 5/2005 Storey et al.
6,899,443 B2 5/2005 Rizkin et al.
6,945,672 B2 9/2005 Du et al.
6,951,415 B2 10/2005 Amano et al.
7,001,047 B2 2/2006 Holder et al.
7,029,150 B2 4/2006 Finch
7,097,334 B2 8/2006 Ishida et al.
7,121,691 B2 10/2006 Coushaine et al.
7,131,760 B2 11/2006 Mayer et al.
7,178,937 B2 2/2007 McDermott
7,214,952 B2 5/2007 Klipstein et al.
7,230,280 B2 6/2007 Yaw et al.
7,246,917 B2 * 7/2007 Rhoads et al. ..... 362/241
7,246,921 B2 7/2007 Jacobson et al.
7,270,448 B1 9/2007 Maley, Sr.
7,329,029 B2 2/2008 Chaves et al.
2002/0024818 A1 * 2/2002 Kondo et al. ..... 362/516
2002/0136025 A1 9/2002 Zhang
2003/0063475 A1 4/2003 Simmons
2003/0202349 A1 10/2003 Suehiro et al.
2004/0114366 A1 6/2004 Smith et al.
2004/0155565 A1 8/2004 Holder et al.
2006/0164836 A1 7/2006 Suehiro et al.
2006/0262524 A1 11/2006 Kah, Jr.
2007/0137074 A1 6/2007 Van de Ven
2007/0139923 A1 6/2007 Negley
2007/0170447 A1 7/2007 Negley
2007/0171145 A1 7/2007 Coleman
2007/0189017 A1 8/2007 Hofmann
2007/0236911 A1 10/2007 Negley
2007/0263393 A1 11/2007 Van de Ven
2007/0274063 A1 11/2007 Negley
2007/0274080 A1 11/2007 Negley
2007/0278934 A1 12/2007 Van de Ven
2007/0279440 A1 12/2007 Negley
2007/0279903 A1 12/2007 Negley
2007/0280624 A1 12/2007 Negley
2008/0074885 A1 3/2008 Brands et al.
2008/0084685 A1 4/2008 Van de Ven
2008/0084700 A1 4/2008 Van de Ven
2008/0084701 A1 4/2008 Van de Ven
2008/0088248 A1 4/2008 Myers
2008/0089053 A1 4/2008 Negley
2008/0106895 A1 5/2008 Van de Ven
2008/0106907 A1 5/2008 Trott
2008/0112168 A1 5/2008 Pickard
2008/0112170 A1 5/2008 Trott
2008/0112183 A1 5/2008 Negley
2008/0130298 A1 6/2008 Negley
2008/0137347 A1 6/2008 Trott
2008/0192477 A1 * 8/2008 Holder et al. ..... 362/294
2008/0278950 A1 11/2008 Pickard
2008/0278952 A1 11/2008 Trott
2008/0278957 A1 11/2008 Pickard
2008/0304261 A1 12/2008 Van de Ven
2008/0304269 A1 12/2008 Pickard
2008/0309255 A1 12/2008 Myers
2009/0108269 A1 4/2009 Negley
2009/0184666 A1 7/2009 Myers
2010/0172152 A1 7/2010 Boonekamp

* cited by examiner

LIGHTING DEVICE WITH MULTIPLE-REGION REFLECTOR

FIELD OF THE INVENTIVE SUBJECT MATTER

The present inventive subject matter is directed to lighting devices. In particular, the present inventive subject matter is directed to lighting devices that have a multiple-region reflector. In some embodiments of the present inventive subject matter, there are provided lighting devices that comprise at least one solid state light emitter.

BACKGROUND

A large proportion (some estimates are as high as twenty-five percent) of the electricity generated in the United States each year goes to lighting. Accordingly, there is an ongoing need to provide lighting which is more energy-efficient.

One type of conventional light is referred to as a back-reflecting lamp. With such a light, a light source (or plural light sources) is oriented so as to emit light toward a reflector, such that light that is emitted by the light source is reflected by the reflector and exits the light in a direction generally opposite to the direction that it is emitted by the light source. Well known examples of such back-reflecting lamps include most PAR lamps and most MR lamps.

PAR lamps are widely used for concerts, nightclubs and touring productions. PAR cans come in a variety of sizes and shapes; from the small PAR16 to the 1000 watt PAR64.

"PAR" is an acronym for parabolic aluminized reflector and is used to designate a sealed-beam lamp similar to the headlight in an automobile. PAR lamps are available in an assortment of wattages and beam spreads as well. For example, a PAR56 lamp may be purchase at 300 or 500 watts, and each wattage is available in Narrow Spot, Medium Flood or Wide Flood.

Typically, a PAR can is a lamp housing that safely holds the lamp and any color media (gel) in place. The can may also have a mounting bracket that allows it to be bolted to a light bar or truss or by use of a pipe clamp.

"MR" stands for multifaceted reflector, a pressed glass reflector with the inside (reflecting side) surface composed of facets and covered by a reflective coating. These facets provide optical control by gathering the light from the filament to create a concentrated beam of light. The reflectors of some MR lamps have a smooth inside surface instead of facets, but they are still called MR lamps by convention.

The light source of MR lamps is usually a single-ended quartz halogen filament capsule. The reflective coating of MR16 lamps is usually either dichroic or aluminum. A dichroic coating is a thin, multi-layer dielectric (non-metallic film) that allows infrared radiation (heat) from the filament capsule to pass through the reflector while it reflects visible radiation (light) forward. An aluminum coating is a thin film of aluminum that, unlike the dichroic coating, reflects both infrared and visible radiation. Some MR16 lamps have a cover glass on the front end of the reflector. This cover is a safety measure designed to contain any broken fragments in case the lamp shatters when it fails.

FIGS. 1 and 2 depict a conventional back-reflecting PAR lamp (or "reflector lamp"). FIG. 1 is a top view, and FIG. 2 is a cross-sectional view taken along the line 2-2 of FIG. 1. FIGS. 1 and 2 show a lamp 10 that comprises a light source 11 and a reflector 12. The light source 11 is aimed at the reflector 12 such that light from the light source 11 is directed away from the aperture 13 of the reflector 12 and then is reflected by the reflector 12 out the aperture 13 of the reflector 12. The light source 11 is suspended on a bridge 14 that extends diametrically across the aperture 13 (alternatively, the bridge 14 can cantilever radially over the aperture 13).

BRIEF SUMMARY OF THE INVENTIVE SUBJECT MATTER

One problem with back-reflecting lamps, such as the one depicted in FIGS. 1 and 2, is that the light source is suspended over the reflector and, therefore, obscures a portion of the reflector. In addition, the reflected light that is obscured by the light source itself is in some cases the highest output portion of the light source. Thus, the amount of loss resulting from obscuration by the light source may be disproportionately high compared to the overall area of the light source. A further loss of light can occur as a result of the inclusion of a bridge, which obscures further portions of the reflector.

Various attempts have been made to avoid or reduce the losses described above. For example, in U.S. Pat. No. 7,131,760 (the '760 patent), there is disclosed an "m" shaped reflector designed to direct light around a bridge. As shown in FIG. 4 of the '760 patent, however, the light reflected around the bridge continues to diverge. Such divergence may limit the effectiveness of devices according to the '760 patent for generating tightly focused beams of light (e.g., an 8 or 16 degree beam). This problem may be exacerbated with larger-sized light sources, and may reach an extent where the light source is no longer a point source of light.

The present inventive subject matter takes into consideration the above-described problems, and which, in some embodiments, provides for reduced losses of light. In some embodiments, the lighting devices according to the present inventive subject matter provide tight beams of light, e.g., beams which can function as spot lights (as opposed to flood lights).

In accordance with some embodiments of the present inventive subject matter, there is provided a lighting device that comprises a light source and a reflector that has at least three profiles, i.e., a first reflector region having a first profile, a second reflector region having a second profile, and a third reflector region having a third profile.

In some embodiments in accordance with the present inventive subject matter, there is provided a back-reflecting lamp in which:

the first reflector region is below the light source and reflects light (e.g., light that would otherwise be obscured by the light source) onto the third reflector region;

light that would not be obscured by the light source is directed out of the fixture by the second reflector region; and the third reflector region redirects light in a path that is substantially parallel to the path of light reflected by the second reflector region. In some of such embodiments, the profile of the first reflector region is such that a focus point of light from the first reflector region falls on the third reflector region. In some of such embodiments, the third reflector region does not receive light directly from the light source.

The inventive subject matter makes it possible, in some embodiments, to provide a back-reflecting lamp which utilizes some of the light that would otherwise be obscured by the light source and/or by a support structure (e.g., a bridge as discussed above) for the light source. In some of such embodiments, this light can be utilized while still providing a relatively tight focused beam of light.

In accordance with some embodiments of the present inventive subject matter, there is provided a lighting device, comprising at least one light source.

In accordance with some embodiments of the present inventive subject matter, there is provided a lighting device, comprising: at least one reflector, the reflector comprising at least a first reflector region, a second reflector region and a third reflector region.

In accordance with some embodiments of the present inventive subject matter, there is provided a lighting device in which when a light source is illuminated, a first portion of light emitted by the light source is reflected by a first reflector region and then by a third reflector region.

In accordance with some embodiments of the present inventive subject matter, there is provided a lighting device in which a second portion of light emitted by the light source is reflected by a second reflector region and forms a primary beam of light exiting the lighting device, the primary beam of light being of a shape that is of a minimum cross-sectional area, at a first distance from the lighting device, that encompasses at least 90% of the light reflected by the second reflector region, and at least 5% of a first portion of light that is reflected by a third reflector region is within the primary beam of light.

In accordance with some embodiments of the present inventive subject matter, there is provided a lighting device in which when a light source is illuminated, at least 5% of all light reflected by a first reflector region travels from the first reflector region directly to a third reflector region.

In accordance with some embodiments of the present inventive subject matter, there is provided a lighting device in which when a light source is illuminated, at least 5% of all light reflected by a third reflector region traveled directly from a first reflector region to the third reflector region.

In accordance with some embodiments of the present inventive subject matter, there is provided a lighting device comprising reflecting means for reflecting a first portion of light emitted by a light source out of the lighting device as a primary beam of light exiting the lighting device, the primary beam of light being of a shape that is of a minimum cross-sectional area, at a first distance from the lighting device, that encompasses at least 75% of the light reflected by a second reflector region, and the reflector comprising means for reflecting at least 5% of a second portion of light emitted by the light source at least twice and to be within the primary beam of light.

In accordance with some embodiments of the present inventive subject matter, there is provided a lighting device comprising reflecting means for reflecting at least 5% of all light reflected by a first reflector region directly to a third reflector region.

In accordance with some embodiments of the present inventive subject matter, there is provided a lighting device comprising reflecting means for reflecting light such that at least 5% of all light reflected by a third reflector region traveled directly from a first reflector region to a third reflector region.

In accordance with a first aspect of the present inventive subject matter, there is provided a lighting device, comprising:

at least one light source and at least one reflector, the reflector comprising at least a first reflector region, a second reflector region and a third reflector region, wherein when the light source is illuminated:

a first portion of light emitted by the light source is reflected by the first reflector region and then by the third reflector region, a second portion of light emitted by the light source is reflected by the second reflector region and forms a primary beam of light exiting the lighting device, the primary beam of light being of a shape that is of a minimum cross-sectional area, at a first distance from the lighting device, that encompasses at least 90% of the light reflected by the second reflector region (or at least 80% of the light reflected by the second reflector region, or at least 75%, at least 50% or at least 25% of the light reflected by the second reflector region), and at least 5% of the first portion of light (and in some embodiments at least 10% of the first portion of light, and in some embodiments at least 15%, at least 20%, at least 25%, at least 30%, at least 35%, at least 40%, at least 45%, at least 50%, at least 55%, at least 60%, at least 65%, at least 70%, at least 75%, at least 80%, at least 85%, at least 90% or at least 95% of the first portion of light), that is reflected by the third reflector region is within the primary beam of light. The first aspect of the present inventive subject matter encompasses lighting devices that are within the above description with any combination of (1) the percentage of light reflected by the second reflector region that is within the minimum cross-sectional area at a first distance from the lighting device, and (2) the percentage of the first portion of light that is reflected by the third reflector region and is within the primary beam of light, for example:

(a) the primary beam of light is of a shape that is of a minimum cross-sectional area, at a first distance from the lighting device, that encompasses at least 50% of the light reflected by the second reflector region, and (b) at least 35% of the first portion of light that is reflected by the third reflector region is within the primary beam of light.

In accordance with a second aspect of the present inventive subject matter, there is provided a lighting device, comprising:

at least one light source and at least one reflector, the reflector comprising at least a first reflector region, a second reflector region and a third reflector region, wherein:

when the light source is illuminated, at least 5% of all light reflected by the first reflector region (and in some embodiments at least 10% of all light reflected by the first reflector region, and in some embodiments at least 15%, at least 20%, at least 25%, at least 30%, at least 35%, at least 40%, at least 45%, at least 50%, at least 55%, at least 60%, at least 65%, at least 70%, at least 75%, at least 80%, at least 85%, at least 90% or at least 95% of all light reflected by the first reflector region) travels from the first reflector region directly to the third reflector region.

In accordance with a third aspect of the present inventive subject matter, there is provided a lighting device, comprising:

at least one light source and at least one reflector, the reflector comprising at least a first reflector region, a second reflector region and a third reflector region, wherein:

when the light source is illuminated, at least 5% of all light reflected by the third reflector region (and in some embodiments at least 10% of all light reflected by the third reflector region, and in some embodiments at least 15%, at least 20%, at least 25%, at least 30%, at least 35%, at least 40%, at least 45%, at least 50%, at least 55%, at least 60%, at least 65%, at least 70%, at least 75%, at least 80%, at least 85%, at least 90% or at least 95% of all light reflected by the third reflector region) traveled directly from the first reflector region to the third reflector region.

The present inventive subject matter also provides, in some embodiments, a method comprising:

illuminating a light source; and directing light from the light source toward at least a portion of a reflector, the reflector comprising at least a first reflector region, a second reflector region and a third reflector region, a first portion of light emitted by the light source being reflected by the first reflector region and then by the third reflector region, a second portion of light emitted by the light source being reflected by the second reflector region and forming a primary beam of light exiting the lighting device, the primary beam of light being of a shape that is of a minimum cross-sectional area, at a first distance from the lighting device, that encompasses at least 90% of the light reflected by the second reflector region (or at least 80% of the light reflected by the second reflector region, or at least 75%, at least 50% or at least 25% of the light reflected by the second reflector region), and at least 5% of the first portion of light that is reflected by the third reflector region (and in some embodiments at least 10% of the first portion of light that is reflected by the third reflector region, and in some embodiments at least 15%, at least 20%, at least 25%, at least 30%, at least 35%, at least 40%, at least 45%, at least 50%, at least 55%, at least 60%, at least 65%, at least 70%, at least 75%, at least 80%, at least 85%, at least 90% or at least 95% of the first portion of light that is reflected by the third reflector region) being within the primary beam of light.

The present inventive subject matter also provides, in some embodiments, a method comprising:

illuminating a light source; and directing light from the light source toward at least a portion of a reflector, the reflector comprising at least a first reflector region, a second reflector region and a third reflector region, at least 5% of all light reflected by the first reflector region (and in some embodiments at least 10% of all light reflected by the first reflector region, and in some embodiments at least 15%, at least 20%, at least 25%, at least 30%, at least 35%, at least 40%, at least 45%, at least 50%, at least 55%, at least 60%, at least 65%, at least 70%, at least 75%, at least 80%, at least 85%, at least 90% or at least 95% of all light reflected by the first reflector region) traveling from the first reflector region directly to the third reflector region.

The present inventive subject matter also provides, in some embodiments, a method comprising:

illuminating a light source; and directing light from the light source toward at least a portion of a reflector, the reflector comprising at least a first reflector region, a second reflector region and a third reflector region, at least 5% of all light reflected by the third reflector region (and in some embodiments at least 10% of all light reflected by the third reflector region, and in some embodiments at least 15%, at least 20%, at least 25%, at least 30%, at least 35%, at least 40%, at least 45%, at least 50%, at least 55%, at least 60%, at least 65%, at least 70%, at least 75%, at least 80%, at least 85%, at least 90% or at least 95% of all light reflected by the third reflector region) traveling directly from the first reflector region to the third reflector region.

In some embodiments in accordance with the present inventive subject matter, at least 75% of all light reflected by the third reflector region exits the lighting device directly after being reflected by the third reflector region.

In some embodiments in accordance with the present inventive subject matter, at least 75% of all light reflected by the second reflector region exits the lighting device directly after being reflected by the second reflector region.

In some embodiments in accordance with the present inventive subject matter, at least 75% of all light reflected by the second reflector region traveled directly from the light source to the second reflector region.

In some embodiments in accordance with the present inventive subject matter, not more than 10% of all light emitted by the light source travels from the light source directly to the third reflector region.

In some embodiments in accordance with the present inventive subject matter, the light source comprises at least one solid state light emitter, e.g., at least one light emitting diode.

In some embodiments in accordance with the present inventive subject matter, at least a portion of one or more of the first, second and third reflector regions has a shape that is selected from among substantially elliptical, substantially parabolic and substantially hyperbolic.

In some embodiments in accordance with the present inventive subject matter, at least 90% of the light emitted by the light source travels directly to either the first reflector region or the second reflector region.

In some embodiments according to the first and second aspects (described above) of the present inventive subject matter, at least 75% of all light reflected by the third reflector region (and in some embodiments at least 5% of all light reflected by the third reflector region, and in some embodiments at least 10%, at least 15%, at least 20%, at least 25%, at least 30%, at least 35%, at least 40%, at least 45%, at least 50%, at least 55%, at least 60%, at least 65%, at least 70%, at least 80%, at least 85%, at least 90% or at least 95% of all light reflected by the third reflector region) traveled directly from the first reflector region to the third reflector region.

In some embodiments according to the first and third aspects (described above) of the present inventive subject matter, at least 75% of all light reflected by the first reflector region (and in some embodiments at least 5%, at least 10% of all light reflected by the first reflector region, and in some embodiments at least 15%, at least 20%, at least 25%, at least 30%, at least 35%, at least 40%, at least 45%, at least 50%, at least 55%, at least 60%, at least 65%, at least 70%, at least 80%, at least 85%, at least 90% or at least 95% of all light reflected by the first reflector region) travels from the first reflector region directly to the third reflector region.

In some embodiments of the present inventive subject matter, the third reflector region is outside of the direct path of light from the light source and, as a result, a support structure for the light source can be attached to the third reflector region, so that light from the light source does not directly contact the support. Moreover, in some embodiments, the light that is reflected by the third reflector region is predominantly only light that was previously reflected by the first reflector region, so that in such embodiments, the first reflector region can be shaped so that most of the light that is reflected by the third reflector region (to which the support is attached) is directed to a portion of the third reflector region other than the portion (or portions) to which the support is attached. For reflectors of similar size, such an arrangement may allow for a shorter path to a heat sink that may be provided on the back side of the reflector (i.e., on the side opposite the side that reflects light from the light source).

In some embodiments of the present inventive subject matter that include a support to which the light source is attached, one or more of the first reflector region, the second reflector region and the third reflector region can be profiled so as to reduce or eliminate reflection of light off of such region (or regions) into the support.

In some embodiments of the present inventive subject matter, one or more portions of one or more of the first reflector region, the second reflector region and the third reflector region can be roughened to some degree in order to diffuse light that travels to such portion (or portions), e.g., light that would otherwise be reflected directly into an obstruction (i.e., light that would otherwise be blocked from exiting the lighting device).

In some embodiments of the present inventive subject matter, an axis of the reflector and an axis of light emission of the light source are co-located.

The inventive subject matter may be more fully understood with reference to the accompanying drawings and the following detailed description of the inventive subject matter.

BRIEF DESCRIPTION OF THE DRAWING FIGURES

FIG. 3 is a top view, and FIG. 4 is a cross-sectional view taken along the line 4-4 of FIG. 3.

DETAILED DESCRIPTION OF THE INVENTIVE SUBJECT MATTER

Figure 1:
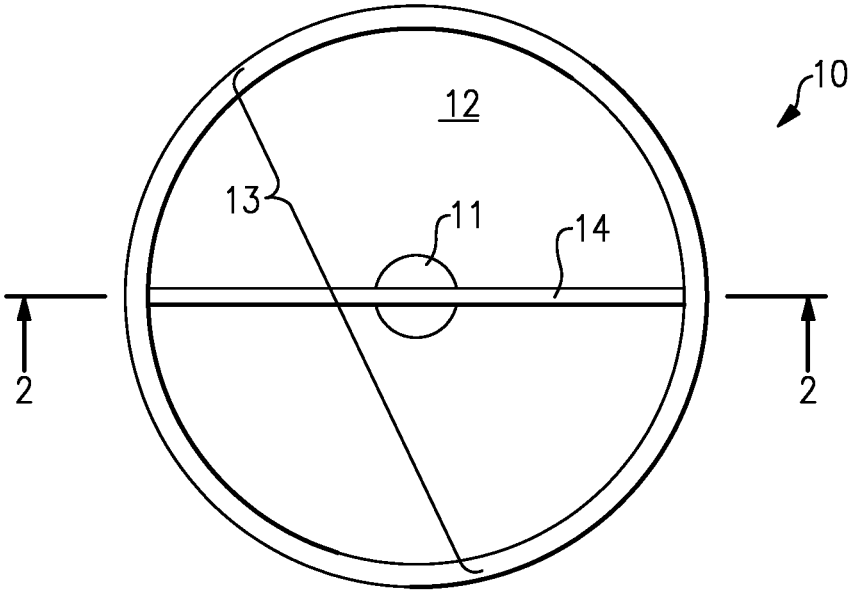
FIGS. 1 and 2 depict a conventional back-reflecting PAR lamp, FIG. 1 being a top view, and FIG. 2 being a cross-sectional view taken along the line 2-2 of FIG. 1.
Figure 2:
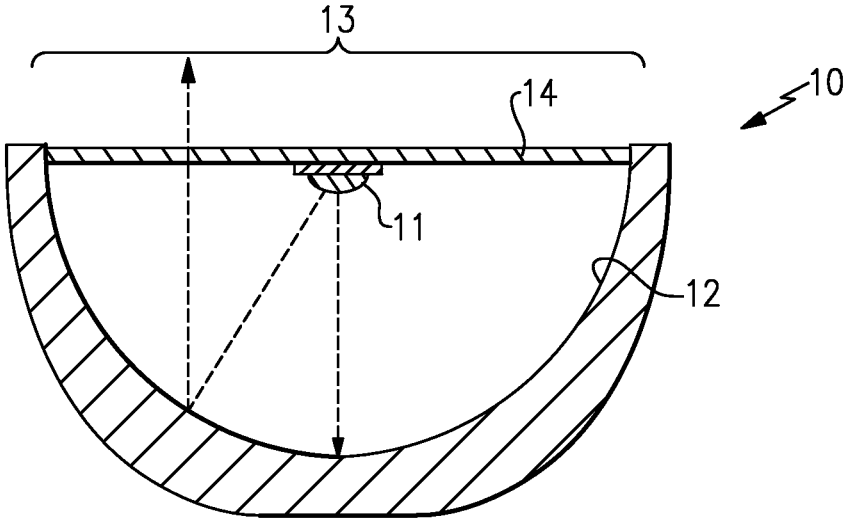

The present inventive subject matter now will be described more fully hereinafter with reference to the accompanying drawings, in which embodiments of the inventive subject matter are shown. However, this inventive subject matter should not be construed as limited to the embodiments set forth herein. Rather, these embodiments are provided so that this disclosure will be thorough and complete, and will fully convey the scope of the inventive subject matter to those skilled in the art. Like numbers refer to like elements throughout. As used herein the term "and/or" includes any and all combinations of one or more of the associated listed items.

The terminology used herein is for the purpose of describing particular embodiments only and is not intended to be limiting of the inventive subject matter. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

When an element such as a layer, region or substrate is referred to herein as being "on" or extending "onto" another element, it can be directly on or extend directly onto the other element or intervening elements may also be present. In contrast, when an element is referred to herein as being "directly on" or extending "directly onto" another element, there are no intervening elements present. Also, when an element is referred to herein as being "connected" or "coupled" to another element, it can be directly connected or coupled to the other element or intervening elements may be present. In contrast, when an element is referred to herein as being "directly connected" or "directly coupled" to another element, there are no intervening elements present. In addition, a statement that a first element is "on" a second element is synonymous with a statement that the second element is "on" the first element.

Although the terms "first", "second", etc. may be used herein to describe various elements, components, regions, layers, sections and/or parameters, these elements, components, regions, layers, sections and/or parameters should not be limited by these terms. These terms are only used to distinguish one element, component, region, layer or section from another region, layer or section. Thus, a first element, component, region, layer or section discussed below could be termed a second element, component, region, layer or section without departing from the teachings of the present inventive subject matter.

Relative terms, such as "lower", "bottom", "below", "upper", "top" or "above," may be used herein to describe one element's relationship to another elements as illustrated in the Figures. Such relative terms are intended to encompass different orientations of the device in addition to the orientation depicted in the Figures. For example, if the device in the Figures is turned over, elements described as being on the "lower" side of other elements would then be oriented on "upper" sides of the other elements. The exemplary term "lower", can therefore, encompass both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

The expression "illuminated" (or "illumination" or the like), as used herein when referring to a light source encompasses situations where the light source emits light continuously or intermittently. In some cases, the light source emits light intermittently at a rate such that a human eye would perceive it as emitting light continuously.

In lighting devices that comprise one or more solid state light emitters, the expression "illuminated" (or "illumination" or the like) means that at least some current is being supplied to the solid state light emitter to cause the solid state light emitter to emit at least some light. The expression "illuminated" thus encompasses situations where the solid state light emitter emits light continuously or intermittently, or where a plurality of solid state light emitters of the same color or different colors are emitting light intermittently and/or alternatingly (with or without overlap in "on" times).

The expression "substantially elliptical", when used to refer to a region of a reflector, means that at least 90% (and in some embodiments at least 95%, and in some embodiments at least 99%) of the points on a portion of that region that extends continuously along at least 50% (and in some embodiments at least 75%, and in some embodiments at least 90%) of a cross-section of that region are spaced from an imaginary ellipse by a distance not more than one hundredth (and in some embodiments one thousandth) of the length of that cross-section.

The expression "substantially parabolic", when used to refer to a region of a reflector, means that at least 90% (and in some embodiments at least 95%, and in some embodiments at least 99%) of the points on a portion of that region that extends continuously along at least 50% (and in some embodiments at least 75%, and in some embodiments at least 90%) of a cross-section of that region are spaced from an imaginary parabola by a distance not more than one hundredth (and in some embodiments one thousandth) of the length of that cross-section.

The expression "substantially hyperbolic", when used to refer to a region of a reflector, means that at least 90% (and in some embodiments at least 95%, and in some embodiments at least 99%) of the points on a portion of that region that extends continuously along at least 50% (and in some embodiments at least 75%, and in some embodiments at least 90%) of a cross-section of that region are spaced from an imaginary hyperbola by a distance not more than one hundredth (and in some embodiments one thousandth) of the length of that cross-section.

The expression "lighting device", as used herein, is not limited, except that it indicates that the device is capable of emitting light. That is, a lighting device can be a device which illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge or back-lighting (e.g., back light poster, signage, LCD displays), bulb replacements (e.g., for replacing AC incandescent lights, low voltage lights, fluorescent lights, etc.), lights used for outdoor lighting, lights used for security lighting, lights used for exterior residential lighting (wall mounts, post/column mounts), ceiling fixtures/wall sconces, under cabinet lighting, lamps (floor and/or table and/or desk), landscape lighting, track lighting, task lighting, specialty lighting, ceiling fan lighting, archival/art display lighting, high vibration/impact lighting—work lights, etc., mirrors/vanity lighting, or any other light emitting device.

The present inventive subject matter further relates to an illuminated enclosure (the volume of which can be illuminated uniformly or non-uniformly), comprising an enclosed space and at least one lighting device according to the present inventive subject matter, wherein the lighting device illuminates at least a portion of the enclosed space (uniformly or non-uniformly).

The present inventive subject matter is further directed to an illuminated area, comprising at least one item, e.g., selected from among the group consisting of a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, etc., having mounted therein or thereon at least one lighting device as described herein.

Unless otherwise defined, all terms (including technical and scientific terms) used herein have the same meaning as commonly understood by one of ordinary skill in the art to which this inventive subject matter belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein. It will also be appreciated by those of skill in the art that references to a structure or feature that is disposed "adjacent" another feature may have portions that overlap or underlie the adjacent feature.

As noted above, the present inventive subject matter is directed to a lighting device, comprising:

at least one light source and at least one reflector, the reflector comprising at least a first reflector region, a second reflector region and a third reflector region.

Persons of skill in the art are familiar with a wide variety of light sources, and any desired light source can be employed in accordance with the present inventive subject matter. Representative examples of light sources include incandescent lights, fluorescent lamps, solid state light emitters, laser diodes, thin film electroluminescent devices, light emitting polymers (LEPs), halogen lamps, high intensity discharge lamps, electron-stimulated luminescence lamps, etc.

A variety of solid state light emitters are well known, and any of such light emitters can be employed according to the present inventive subject matter. Representative examples of solid state light emitters include light emitting diodes (inorganic or organic, including polymer light emitting diodes (PLEDs)) with or without luminescent materials.

Light emitting diodes are semiconductor devices that convert electrical current into light. A wide variety of light emitting diodes are used in increasingly diverse fields for an ever-expanding range of purposes.

More specifically, light emitting diodes are semiconducting devices that emit light (ultraviolet, visible, or infrared) when a potential difference is applied across a p-n junction structure.

The present inventive subject matter is particularly effective in connection with the use of a light emitting diode (or a plurality of light emitting diodes) as the light source, because many embodiments of light emitting diodes emit light in one hemisphere, making them especially applicable for lighting devices in which the emitted light is reflected, e.g., back-reflecting lamps.

The expression "light emitting diode" is used herein to refer to the basic semiconductor diode structure (i.e., the chip). The commonly recognized and commercially available "LED" that is sold (for example) in electronics stores typically represents a "packaged" device made up of a number of parts. These packaged devices typically include a semiconductor based light emitting diode such as (but not limited to) those described in U.S. Pat. Nos. 4,918,487; 5,631,190; and 5,912,477; various wire connections, and a package that encapsulates the light emitting diode.

Some embodiments of the lighting devices according to the present inventive subject matter include two or more light emitters. In such lighting devices, the respective light emitters can be similar to one another, different from one another, or any combination (i.e., there can be a plurality of light emitters of one type, or one or more light emitters of each of two or more types).

The lighting devices according to the present inventive subject matter can comprise any desired number of light emitters. For example, a lighting device according to the present inventive subject matter can include a single light emitting diode, fifty or more light emitting diodes, 1000 or more light emitting diodes, fifty or more light emitting diodes and two incandescent lights, 100 light emitting diodes and one fluorescent light, etc. In embodiments where the light emitter(s) comprises one or more solid state light emitters, any desired solid state light emitter or emitters can be employed.

As indicated above, solid state light emitters can, if desired, comprise one or more luminescent materials, a wide variety of which are well known and available to persons of skill in the art. For example, a phosphor is a luminescent material that emits a responsive radiation (e.g., visible light) when excited by a source of exciting radiation. In many instances, the responsive radiation has a wavelength which is different from the wavelength of the exciting radiation. Other examples of luminescent materials include scintillators, day glow tapes and inks which glow in the visible spectrum upon illumination with ultraviolet light.

Luminescent materials can be categorized as being down-converting, i.e., a material which converts photons to a lower energy level (longer wavelength) or up-converting, i.e., a material which converts photons to a higher energy level (shorter wavelength).

Inclusion of luminescent materials in solid state light emitters has been accomplished in a variety of ways, one representative way being by adding the luminescent materials to a clear or transparent encapsulant material (e.g., epoxy-based, silicone-based, glass-based or metal oxide-based material) as discussed above, for example by a blending or coating process.

For example, one representative example of a conventional light emitting diode lamp includes a light emitting diode chip, a bullet-shaped transparent housing to cover the light emitting diode chip, leads to supply current to the light emitting diode chip, and a cup reflector for reflecting the emission of the light emitting diode chip in a uniform direction, in which the light emitting diode chip is encapsulated with a first resin portion, which is further encapsulated with a second resin portion. The first resin portion can be obtained by filling the cup reflector with a resin material and curing it after the light emitting diode chip has been mounted onto the bottom of the cup reflector and then has had its cathode and anode electrodes electrically connected to the leads by way of wires. A luminescent material can be dispersed in the first resin portion so as to be excited with the light A that has been emitted from the light emitting diode chip, the excited luminescent material produces fluorescence ("light B") that has a longer wavelength than the light A, a portion of the light A is transmitted through the first resin portion including the luminescent material, and as a result, light C, as a mixture of the light A and light B, is used as illumination.

In embodiments where the lighting device includes one or more luminescent materials, the expression "illuminated" (or "illumination" or the like) can include light that has been up-converted or down-converted by one or more luminescent materials.

Representative examples of suitable solid state light emitters, including suitable light emitting diodes, luminescent materials, encapsulants, etc., are described in:

U.S. patent application Ser. No. 11/614,180, filed Dec. 21, 2006 (now U.S. Patent Publication No. 2007/0236911), the entirety of which is hereby incorporated by reference as if set forth in its entirety;

U.S. patent application Ser. No. 11/624,811, filed Jan. 19, 2007 (now U.S. Patent Publication No. 2007/0170447), the entirety of which is hereby incorporated by reference as if set forth in its entirety;

U.S. patent application Ser. No. 11/751,982, filed May 22, 2007 (now U.S. Patent Publication No. 2007/0274080), the entirety of which is hereby incorporated by reference as if set forth in its entirety;

U.S. patent application Ser. No. 11/753,103, filed May 24, 2007 (now U.S. Patent Publication No. 2007/0280624), the entirety of which is hereby incorporated by reference as if set forth in its entirety;

U.S. patent application Ser. No. 11/751,990, filed May 22, 2007 (now U.S. Patent Publication No. 2007/0274063), the entirety of which is hereby incorporated by reference as if set forth in its entirety;

U.S. patent application Ser. No. 11/736,761, filed Apr. 18, 2007 (now U.S. Patent Publication No. 2007/0278934), the entirety of which is hereby incorporated by reference as if set forth in its entirety;

U.S. patent application Ser. No. 11/936,163, filed Nov. 7, 2007 (now U.S. Patent Publication No. 2008/0106895), the entirety of which is hereby incorporated by reference as if set forth in its entirety;

U.S. patent application Ser. No. 11/843,243, filed Aug. 22, 2007 (now U.S. Patent Publication No. 2008/0084685), the entirety of which is hereby incorporated by reference as if set forth in its entirety;

U.S. patent application Ser. No. 11/870,679, filed Oct. 11, 2007 (now U.S. Patent Publication No. 2008/0089053), the entirety of which is hereby incorporated by reference as if set forth in its entirety;

U.S. patent application Ser. No. 12/117,148, filed May 8, 2008 (now U.S. Patent Publication No. 2008/0304261), the entirety of which is hereby incorporated by reference as if set forth in its entirety; and U.S. patent application Ser. No. 12/017,676, filed on Jan. 22, 2008 (now U.S. Patent Publication No. 2009/0108269), the entirety of which is hereby incorporated by reference as if set forth in its entirety.

The reflector can comprise one or more reflector elements (each reflector element being an integral structure that is separate from, i.e., not integral with, any other reflector element), each of which can be made of any desired material or materials. For example, lighting devices that comprise first, second and third reflector regions can comprise a first reflector element that has the first reflector region, the second reflector region and the third reflector region. Alternatively, lighting devices that comprise first, second and third reflector regions can comprise a first reflector element that has the first reflector region and the second reflector region, and a second reflector element that has the third reflector region. Alternatively, lighting devices that comprise first, second and third reflector regions can comprise a first reflector element that has the first reflector region and the third reflector region, and a second reflector element that has the second reflector region. Alternatively, lighting devices that comprise first, second and third reflector regions can comprise a first reflector element that has the second reflector region and the third reflector region, and a second reflector element that has the first reflector region. Alternatively, lighting devices that comprise first, second and third reflector regions can comprise a first reflector element that has the first reflector region, a second reflector element that has the second reflector region, and a third reflector element that has the third reflector region. Similarly, lighting devices that comprises more than first, second and third reflector regions can comprise any number of reflector devices that each respectively has any desired combinations of the reflector regions. In addition, any particular reflector region can comprise any desired number of reflector elements (e.g., a first reflector region can comprise first and second reflector elements; or a first reflector region can comprise a first part of a first reflector element and a first part of a second reflector element, and a second reflector region can comprise a second part of the first reflector element and a second part of the second reflector element; or the respective three or more reflector regions comprise any other combinations of parts or entireties of one or more reflector element(s).

The ability of the reflector to reflect light can be imparted in any desired way, a variety of which are well known to persons of skill in the art. For example, the reflector(s) can comprise one or more material that is reflective (and/or specular, the term "reflective" being used herein to refer to reflective and optionally also specular), and/or that can be treated (e.g., polished) so as to be reflective, or can comprise one or more material that is non-reflective or only partially reflective and which is coated with, laminated to and/or otherwise attached to a reflective material. Persons of skill in the art are familiar with a variety of materials that are reflective, e.g., metals such as aluminum or silver, a dielectric stack of materials forming a Bragg Reflector, a dichroic reflector coating on glass (e.g., as described at www.lumascape.com/pdf/literature/C1087US.pdf), any other thin film reflectors, etc. Persons of skill in the art are familiar with a wide variety of materials which are suitable for making a non-reflective or partially reflective structure which can be coated with, laminated to or otherwise attached to a reflective material, including for instance plastic materials such as polyethylene, polypropylene, natural or synthetic rubbers, polycarbonate or polycarbonate copolymer, PAR (poly(4,4'-isopropylidenediphenylene terephthalate/isophthalate) copolymer), PEI (polyetherimide), and LCP (liquid crystal polymer). The reflector(s) can be formed out of highly reflective aluminum sheet with various coatings, including silver, from companies like Alanod (http://www.alanod.de/opencms/alanod/index.html_2063069299.html.), or the reflector(s) can be formed from glass. In cases where a lighting device according to the present inventive subject matter comprises more than one reflector, the respective reflectors can be made of the same material, or any reflector(s) can be made of different materials.

Representative examples of suitable reflectors (and arrangements thereof) are described in many patents, e.g., U.S. Pat. Nos. 6,945,672, 7,001,047, 7,131,760, 7,214,952 and 7,246,921 (the entireties of which are hereby incorporated by reference), each of which describes, inter alia, back-reflectors.

In some embodiments in accordance with the present inventive subject matter, the third reflective region is positioned so that not more than 10% (and in some embodiments, not more than 5%, and in some embodiments substantially none) of the light emitted by the light source travels directly from the light source to the third reflective region. In some embodiments in accordance with the present inventive subject matter, the entirety of the third reflective region is positioned on the side of a plane defined by an emission surface of the light source that is opposite to the side of the plane into which the light is emitted by the light source. In some embodiments in accordance with the present inventive subject matter, the light source emits light in less than 180 degrees (as a result of the shape of the light source and/or the nature of the light source, and/or as a result of a shade positioned relative to the light source, and/or as a result of some other angular control of the light emanating from the light source), and in some of such embodiments, the third reflective region can be positioned on the side of the plane of an emission surface of the light source into which the light is directed (or can extend into that side of the plane) without any light traveling directly from the light source to the third reflective region.

Any lighting device in accordance with the present inventive subject matter can comprise one or more lenses. Persons of skill in the art are familiar with a wide variety of materials out of which lenses can be made, and are familiar with a wide variety of shapes that such lenses can be, and any of such materials and shapes can be employed in embodiments according to the present inventive subject matter that include a lens (or plural lenses). As will be understood by persons skilled in the art, a lens in a lighting device according to the present inventive subject matter can have any desired effect on incident light (or no effect), such as focusing, diffusing, etc.

In embodiments in accordance with the present inventive subject matter that include a lens (or plural lenses), the lens (or lenses) can be positioned in any desired location and orientation. In some embodiments in accordance with the present inventive subject matter (e.g., the embodiment depicted in FIGS. 3 and 4, discussed below), the lens is positioned adjacent to and covering an aperture of the reflector.

Any lighting device in accordance with the present inventive subject matter can comprise one or more media positioned therein, through which light passes as it travels from a light source to a reflector region, from one reflector region to another reflector region, or from a reflector region out of the lighting device. Such a medium (or media) can be solid, liquid and/or gaseous, as desired. Where plural media are included, the respective media can each independently be solid, liquid and/or gaseous (e.g., all of the media might be solid, or one medium might be solid and another might be liquid, etc.). For instance, in an embodiment that comprises a reflector and a lens covering an aperture of the reflector, a region surrounded by the reflector and the lens can be filled (completely or partially) with any desired medium, such as air or substantially transparent glass. Where a plurality of media are provided, the respective media can have the same or different indices of refraction, as desired.

The lighting devices of the present inventive subject matter can be supplied with electricity in any desired manner. Skilled artisans are familiar with a wide variety of power supplying apparatuses, and any such apparatuses can be employed in connection with the present inventive subject matter. The lighting devices of the present inventive subject matter can be electrically connected (or selectively connected) to any desired power source, persons of skill in the art being familiar with a variety of such power sources.

Representative examples of apparatuses for supplying electricity to lighting devices and power supplies for lighting devices, all of which are suitable for the lighting devices of the present inventive subject matter, are described in:

U.S. patent application Ser. No. 11/626,483, filed Jan. 24, 2007 (now U.S. Patent Publication No. 2007/0171145), the entirety of which is hereby incorporated by reference as if set forth in its entirety;

U.S. patent application Ser. No. 11/755,162, filed May 30, 2007 (now U.S. Patent Publication No. 2007/0279440), the entirety of which is hereby incorporated by reference as if set forth in its entirety;

U.S. patent application Ser. No. 11/854,744, filed Sep. 13, 2007 (now U.S. Patent Publication No. 2008/0088248), the entirety of which is hereby incorporated by reference as if set forth in its entirety;

U.S. patent application Ser. No. 12/117,280, filed May 8, 2008 (now U.S. Patent Publication No. 2008/0309255), the entirety of which is hereby incorporated by reference as if set forth in its entirety; and U.S. patent application Ser. No. 12/328,144, filed Dec. 4, 2008 (now U.S. Patent Publication No. 2009/0184666), the entirety of which is hereby incorporated by reference as if set forth in its entirety.

The lighting devices according to the first aspect of the present inventive subject matter can further comprise any desired electrical connector, a wide variety of which are familiar to those of skill in the art, e.g., an Edison connector (for insertion in an Edison socket), a GU-24 connector, etc.

In some embodiments according to the present inventive subject matter, the lighting device is a self-ballasted device. For example, in some embodiments, the lighting device can be directly connected to AC current (e.g., by being plugged into a wall receptacle, by being screwed into an Edison socket, by being hard-wired into a circuit, etc.). Representative examples of self-ballasted devices are described in U.S. patent application Ser. No. 11/947,392, filed on Nov. 29, 2007 (now U.S. Patent Publication No. 2008/0130298), the entirety of which is hereby incorporated by reference as if set forth in its entirety.

The housing of the present inventive subject matter can be any desired housing or fixture. Skilled artisans are familiar with a wide variety of housings and fixtures, any of which can be employed in connection with the present inventive subject matter.

For example, fixtures, other mounting structures, mounting schemes, housings and complete lighting assemblies which may be used in practicing the present inventive subject matter are described in:

U.S. patent application Ser. No. 11/613,692, filed Dec. 20, 2006 (now U.S. Patent Publication No. 2007/0139923), the entirety of which is hereby incorporated by reference as if set forth in its entirety;

U.S. patent application Ser. No. 11/613,733, filed Dec. 20, 2006 (now U.S. Patent Publication No. 2007/0137074), the entirety of which is hereby incorporated by reference as if set forth in its entirety;

U.S. patent application Ser. No. 11/743,754, filed May 3, 2007 (now U.S. Patent Publication No. 2007/0263393), the entirety of which is hereby incorporated by reference as if set forth in its entirety;

U.S. patent application Ser. No. 11/755,153, filed May 30, 2007 (now U.S. Patent Publication No. 2007/0279903), the entirety of which is hereby incorporated by reference as if set forth in its entirety;

U.S. patent application Ser. No. 11/856,421, filed Sep. 17, 2007 (now U.S. Patent Publication No. 2008/0084700), the entirety of which is hereby incorporated by reference as if set forth in its entirety;

U.S. patent application Ser. No. 11/859,048, filed Sep. 21, 2007 (now U.S. Patent Publication No. 2008/0084701), the entirety of which is hereby incorporated by reference as if set forth in its entirety;

U.S. patent application Ser. No. 11/939,047, filed Nov. 13, 2007 (now U.S. Patent Publication No. 2008/0112183), the entirety of which is hereby incorporated by reference as if set forth in its entirety;

U.S. patent application Ser. No. 11/939,052, filed Nov. 13, 2007 (now U.S. Patent Publication No. 2008/0112168), the entirety of which is hereby incorporated by reference as if set forth in its entirety;

U.S. patent application Ser. No. 11/939,059, filed Nov. 13, 2007 (now U.S. Patent Publication No. 2008/0112170), the entirety of which is hereby incorporated by reference as if set forth in its entirety;

U.S. patent application Ser. No. 11/877,038, filed Oct. 23, 2007 (now U.S. Patent Publication No. 2008/0106907), the entirety of which is hereby incorporated by reference as if set forth in its entirety;

U.S. Patent Application No. 60/861,901, filed on Nov. 30, 2006, entitled "LED DOWNLIGHT WITH ACCESSORY ATTACHMENT" (inventors: Gary David Trott, Paul Kenneth Pickard and Ed Adams; attorney docket number 931_044 PRO), the entirety of which is hereby incorporated by reference as if set forth in its entirety;

U.S. patent application Ser. No. 11/948,041, filed Nov. 30, 2007 (now U.S. Patent Publication No. 2008/0137347), the entirety of which is hereby incorporated by reference as if set forth in its entirety;

U.S. patent application Ser. No. 12/114,994, filed May 5, 2008 (now U.S. Patent Publication No. 2008/0304269), the entirety of which is hereby incorporated by reference as if set forth in its entirety;

U.S. patent application Ser. No. 12/116,341, filed May 7, 2008 (now U.S. Patent Publication No. 2008/0278952), the entirety of which is hereby incorporated by reference as if set forth in its entirety;

U.S. patent application Ser. No. 12/116,346, filed May 7, 2008 (now U.S. Patent Publication No. 2008/0278950), the entirety of which is hereby incorporated by reference as if set forth in its entirety; and U.S. patent application Ser. No. 12/116,348, filed on May 7, 2008 (now U.S. Patent Publication No. 2008/0278957), the entirety of which is hereby incorporated by reference as if set forth in its entirety.

Embodiments in accordance with the present inventive subject matter are described herein with reference to cross-sectional (and/or plan view) illustrations that are schematic illustrations of idealized embodiments of the present inventive subject matter. As such, variations from the shapes of the illustrations as a result, for example, of manufacturing techniques and/or tolerances, are to be expected. Thus, embodiments of the present inventive subject matter should not be construed as being limited to the particular shapes of regions illustrated herein but are to include deviations in shapes that result, for example, from manufacturing. For example, a molded region illustrated or described as a rectangle will, typically, have rounded or curved features. Thus, the regions illustrated in the figures are schematic in nature and their shapes are not intended to illustrate the precise shape of a region of a device and are not intended to limit the scope of the present inventive subject matter.

Figure 3:
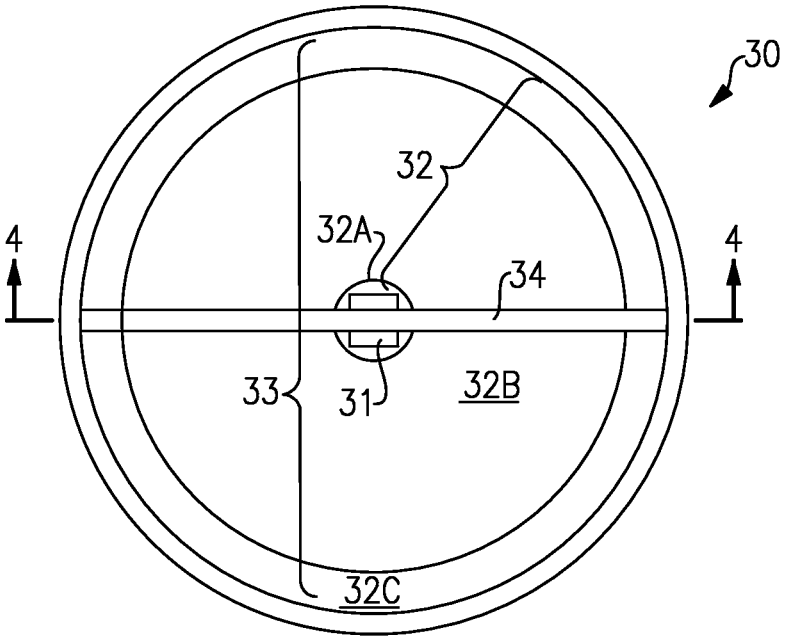
FIGS. 3 and 4 depict a first embodiment of a lighting device in accordance with the present inventive subject matter.
Figure 4:
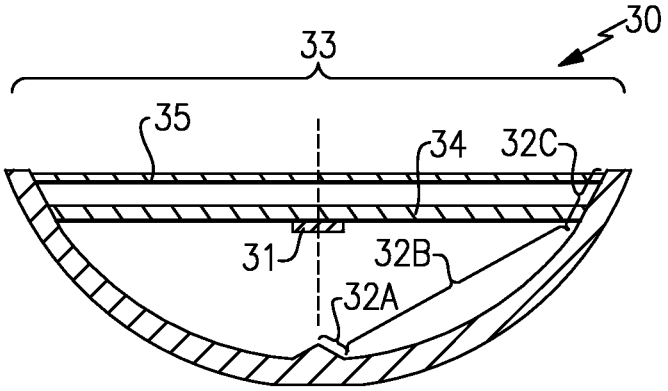

FIGS. 3 and 4 depict a first embodiment of a lighting device in accordance with the present inventive subject matter. FIG. 3 is a top view, and FIG. 4 is a cross-sectional view taken along the line 4-4 of FIG. 3 (FIG. 4 is of a scale that differs from that of FIG. 3). FIGS. 3 and 4 show a lighting device 30 that comprises a light source 31 and a reflector 32. The reflector 32 comprises a first reflector region 32A, a second reflector region 32B and a third reflector region 32C. The light source 31 is aimed at the reflector 32, and can be suspended on a bridge 34 that extends diametrically across the aperture 33. The lighting device 30 can further comprise a transparent lens 35 that covers the aperture 33.

The light source 31 can comprise a multi-chip LED package that emits light that is perceived by humans as white light. The multi-chip LED package can include plural light emitting diode chips that emit respective hues of light that, when mixed, are perceived in combination as white light (or near white light, e.g., within 4 MacAdam ellipses of the blackbody locus on a 1931 CIE Chromaticity Diagram). Alternatively, the light source 31 could be a multi-chip LED package with the same colors (e.g., an LED that includes a light emitting diode that emits blue light and a phosphor that converts some of the blue light to a longer wavelength to produce a mixture of light that is white) or a large chip in a small scale reflector (akin to an MR16 or a PAR20).

Figure 5:
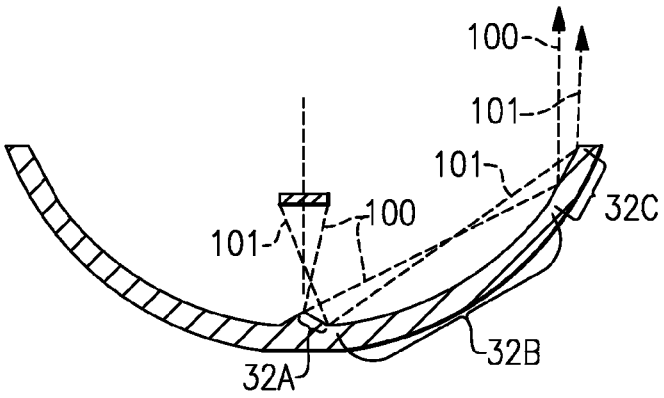
FIG. 5 is identical to FIG. 4, except that some of the reference numbers are not shown, and some structure and components are omitted for clarity in showing the light paths.
Figure 6:
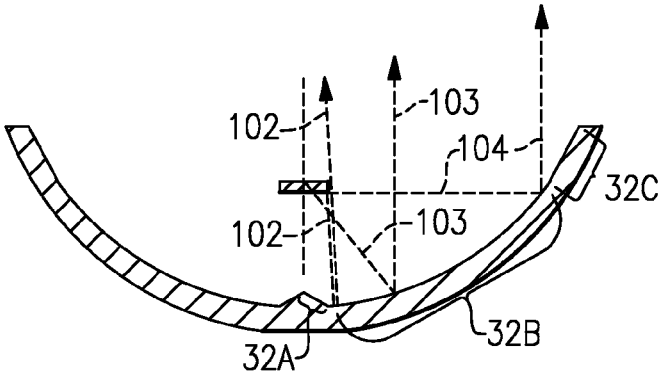
FIG. 6 is identical to FIG. 4, except that some of the reference numbers are not shown, and some structure and components are omitted for clarity in showing other light paths.

In this embodiment, when the light source 31 is illuminated, a first portion of light emitted by the light source 31 is reflected by the first reflector region 32A and then by the third reflector region 32C (see light paths 100 and 101 depicted in FIG. 5, which is identical to FIG. 4, except that some of the reference numbers are not shown, and some structure and components are omitted for clarity in showing the light paths), and a second portion of light emitted by the light source 31 is reflected by the second reflector region 32B (see light paths 102, 103 and 104 depicted in FIG. 6, which is identical to FIG. 4, except that some of the reference numbers are not shown, and some structure and components are omitted for clarity in showing other light paths), and forms a primary beam of light exiting the lighting device. The primary beam of light is defined by an imaginary frustoconical region extending from the lighting device (generally upward in the orientation depicted in FIG. 6), and in this embodiment, substantially all of the light that is reflected by the second reflector region 32B is within the primary beam. In embodiments where the light reflected by the second reflector region 32B is more scattered, the primary beam would be defined by the frustoconical shape that is of the minimum size (i.e., defines the minimum circumference at any given height above the aperture 33) that encompasses at least 75% of the light reflected by the second reflector region 32B.

In this embodiment, substantially all of the first portion of light that is reflected by the third reflector region is within the primary beam of light. As noted above, in lighting devices in accordance with the first aspect of the present inventive subject matter, at least 5% of the first portion of light that is reflected by the third reflector region is within the primary beam of light.

In this embodiment, substantially all of the light reflected by the first reflector region 32A travels from the first reflector region 32A directly to the third reflector region 32C. As noted above, in some embodiments of lighting devices in accordance with the present inventive subject matter, at least 5% of all light reflected by the first reflector region 32A travels from the first reflector region 32A directly to the third reflector region 32C. The term "directly" as used herein, e.g., in an expression that indicates the light travels from a first structure directly to a second structure means that the light is not reflected between when it leaves the first structure and when it arrives at the second structure. For instance, the expression "light . . . travels from the first reflector region 32A directly to the third reflector region 32C" means that the light is not reflected after it is reflected by the first reflector region 32A and before it arrives at the third reflector region 32C. This does not mean, however, that the light does not pass through any medium (or media) between when it leaves the first structure and when it arrives at the second structure, or that the light is not refracted between when it leaves the first structure and when it arrives at the second structure. As noted above, there can be a medium (or media) positioned such that light passes through such medium (or media) as it travels from a light source to a reflector region, from one reflector region to another reflector region, or from a reflector region out of the lighting device.

In this embodiment, substantially all of the light reflected by the third reflector region 32C exits the lighting device 30 directly after being reflected by the third reflector region 32C. As noted above, in some embodiments of lighting devices in accordance with the present inventive subject matter, at least 75% of all light reflected by the third reflector region 32C exits the lighting device 30 directly after being reflected by the third reflector region 32C.

In this embodiment, substantially all of the light reflected by the second reflector region 32B exits the lighting device 30 directly after being reflected by the second reflector region 32B. As noted above, in some embodiments of lighting devices in accordance with the present inventive subject matter, at least 75% of all light reflected by the second reflector region 32B exits the lighting device 30 directly after being reflected by the second reflector region 32B.

In this embodiment, substantially all of the light reflected by the second reflector region 32B previously traveled directly from the light source 31 to the second reflector region 32B. As noted above, in some embodiments of lighting devices in accordance with the present inventive subject matter, at least 75% of all light reflected by the second reflector region 32B previously traveled directly from the light source 31 to the second reflector region 32B.

In this embodiment, substantially all of the light reflected by the third reflector region 32C traveled directly from the first reflector region 32A to the third reflector region 32C. As noted above, in some embodiments of lighting devices in accordance with the present inventive subject matter, at least 5% of all light reflected by the third reflector region 32C traveled directly from the first reflector region 32A to the third reflector region 32C.

In this embodiment, substantially none of the light emitted by the light source travels from the light source directly to the third reflector region. As noted above, in some embodiments of lighting devices in accordance with the present inventive subject matter, not more than 10% of all light emitted by the light source travels from the light source directly to the third reflector region.

In this embodiment, the first reflector region 32A can have an elliptical profile, the second reflector region 32B can have a profile which is parabolic, elliptical or otherwise to achieve desired beam angle and uniformity, and the third reflector region 32C can have a parabolic profile.

In this embodiment, the first reflector region 32A can have a diameter which is slightly larger than the largest dimension of the light source, i.e., the diagonal distance along the light emitting surface (the bottom surface in the orientation depicted in FIG. 4).

Figure 7:
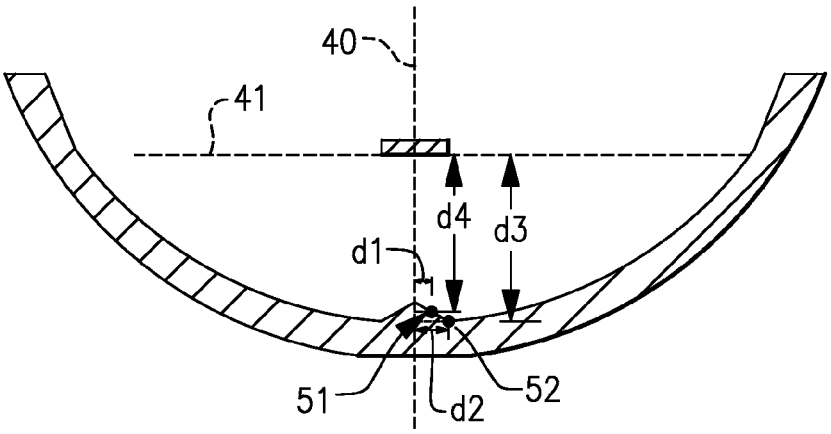
FIG. 7 is identical to FIG. 4, except that some of the reference numbers are not shown, and some structure and components are omitted for clarity in showing the distances d1-d4.

In this embodiment, (a) the distance d2 from the axis 40 of light emission of the light source 31 to the first reflector region 32A at a first reflector region first location 52 (see FIG. 7, which is identical to FIG. 4, except that some of the reference numbers are not shown, and some structure and components are omitted for clarity in showing the distances dl-d4) is larger than (b) the distance dl (see FIG. 7) from the axis 40 of light emission of the light source 31 to the first reflector region 32A at a first reflector region second location 51, the first reflector region first location 52 being spaced from a plane 41 (that passes through the light source and extends substantially perpendicular to the axis of light emission of the light source) by a distance d3 (see FIG. 7) that is larger than the distance d4 (see FIG. 7) that the first reflector region second location 51 is spaced from the plane 41. In fact, in this embodiment, along the first reflector region, the larger the distance from the axis 40, the larger the distance from the plane 41.

In this embodiment, the axis 40 of light emission of the light source 31 is also the axis of the light source 31 and the axis of the reflector 32, i.e., the axis of the light source 31 and the axis of the reflector 32 are co-located (the axis 40 of light emission of the light source 31, the axis of the light source 31 and the axis of the reflector 32 are co-located).

Figure 8:
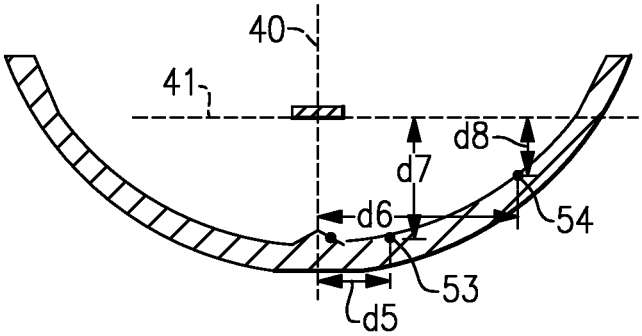
FIG. 8 is identical to FIG. 4, except that some of the reference numbers are not shown, and some structure and components are omitted for clarity in showing the distances d5-d8.

In this embodiment, the distance d5 (see FIG. 8, which is identical to FIG. 4, except that some of the reference numbers are not shown, and some structure and components are omitted for clarity in showing the distances d5-d8) from the axis 40 to the second reflector region 32B is smaller at a second reflector region first location 53 than the distance d6 (see FIG. 8) from the axis 40 to a second reflector region second location 54, the second reflector region first location 53 being spaced from the plane 41 a distance d7 (see FIG. 8) that is larger than the distance d8 (see FIG. 8) that the second reflector region second location 54 is spaced from the plane 41. In fact, in this embodiment, along the second reflector region, the larger the distance from the axis 40, the smaller the distance from the plane 41.

Figure 9:
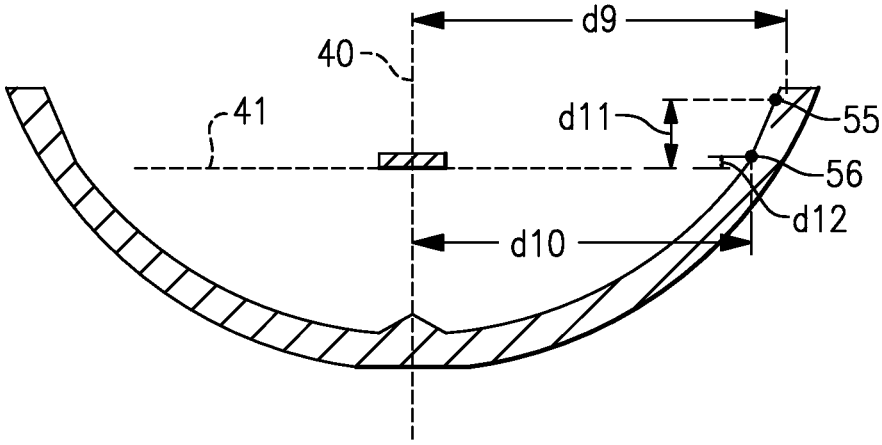
FIG. 9 is identical to FIG. 4, except that some of the reference numbers are not shown, and some structure and components are omitted for clarity in showing the distances d9-d12.

In this embodiment, the distance d9 (see FIG. 9, which is identical to FIG. 4, except that some of the reference numbers are not shown, and some structure and components are omitted for clarity in showing the distances d9-d12) from the axis 40 to the third reflector region 32C is larger at a third reflector region first location 55 than the distance d10 (see FIG. 9) from the axis 40 to a third reflector region second location 56, the third reflector region first location 55 being spaced from the plane 41 a distance d11 (see FIG. 9) that is larger than the distance d12 (see FIG. 9) that the third reflector region second location 56 is spaced from the plane 41. In fact, in this embodiment, along the third reflector region, the larger the distance from the axis 40, the larger the distance from the plane 41.

In this embodiment, substantially all of the light emitted by the light source 31 can travel directly to either the first reflector region 32A or the second reflector region 32B. As noted above, in some embodiments of lighting devices in accordance with the present inventive subject matter, at least 90% of the light emitted by the light source travels directly to either the first reflector region or the second reflector region.

In reflector systems utilizing a suspended emitter firing into the reflector, any single profile reflector (parabolic, elliptical, hyperbolic or similar) will have a certain percentage of the reflected light obscured by the emitter body. Some embodiments in accordance with the present inventive subject matter can comprise a reflector region (which can be elliptical or any other desired shape) directly beneath the emitter and having at least the same diameter as the emitter to redirect the emitter's on-axis light.

In some embodiments in accordance with the present inventive subject matter, the second reflector region may be parabolic, elliptical or some other shape in order to achieve desired beam angle and uniformity parameters, and so the shape of the second reflector region would be non-optimal for re-directing light reflected from beneath the emitter by the first reflector region, because reflecting on the second reflector region light that was previously reflected by the first reflector region would fall outside the useful photometric distribution of the lighting device. By providing, in some embodiments in accordance with the present inventive subject matter, a third reflector region (which in some embodiments may extend above the plane of the light emitter) that has a profile specifically designed for receiving light diverted from beneath the emitter and redirecting it, such redirected light can be part of the useful photometric distribution of the lighting device.

As noted above, in some embodiments in accordance with the present inventive subject matter, the profile for the first reflector region can be substantially elliptical. In such embodiments, the divergence of light reflected by the first reflector region is minimized, so that the size of the third reflector region can be minimized.

In PAR and MR lamps, the center beam candlepower is an extremely important value (i.e., maximizing the center beam candlepower is of great importance). In some embodiments in accordance with the present inventive subject matter, the third reflector region is substantially parabolic, in order to re-direct into the center of the output beam as much light as possible of the light that was reflected by the first reflector region.

Any two or more structural parts of the lighting devices described herein can be integrated. Any structural part of the lighting devices described herein can be provided in two or more parts which are held together, if necessary. Similarly, any two or more functions can be conducted simultaneously, and/or any function can be conducted in a series of steps.

While certain embodiments of the present inventive subject matter have been illustrated with reference to specific combinations of elements, various other combinations may also be provided without departing from the teachings of the present inventive subject matter. Thus, the present inventive subject matter should not be construed as being limited to the particular exemplary embodiments described herein and illustrated in the Figures, but may also encompass combinations of elements of the various illustrated embodiments.

Many alterations and modifications may be made by those having ordinary skill in the art, given the benefit of the present disclosure, without departing from the spirit and scope of the inventive subject matter. Therefore, it must be understood that the illustrated embodiments have been set forth only for the purposes of example, and that it should not be taken as limiting the inventive subject matter as defined by the following claims. The following claims are, therefore, to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the inventive subject matter.

The invention claimed is:

1. A lighting device, comprising:

at least one light source, at least one reflector and at least one bridge, the reflector comprising at least a first reflector region, a second reflector region and a third reflector region, the light source on the bridge, the first reflector region and at least a portion of the second reflector region located to a first side of a plane of emission of the light source, the third reflector region located to a second side of the plane of emission of the light source, the bridge directly attached to the third reflector region, wherein:

when the light source is illuminated, at least 5% of all light reflected by the first reflector region travels from the first reflector region directly to the third reflector region.

2. A lighting device as recited in claim 1, wherein the third reflector region extends around an entire periphery of the second reflector region.

3. A lighting device as recited in claim 1, wherein the first reflector region reflects light in 360 degrees relative to an axis of light emission of the light source.

4. A lighting device as recited in claim 1, wherein light directed anywhere within a region defined by a perimeter of the second reflector region is incident upon at least one of the first reflector region and the second reflector region.

5. A lighting device, comprising:

at least one light source, at least one reflector and at least one bridge, the reflector comprising at least a first reflector region, a second reflector region and a third reflector region, the light source on the bridge, the first reflector region and at least a portion of the second reflector region located to a first side of a plane of emission of the light source, the third reflector region located to a second side of the plane of emission of the light source, the bridge directly attached to the third reflector region, wherein:

when the light source is illuminated, at least 5% of all light reflected by the third reflector region traveled directly from the first reflector region to the third reflector region.

6. A lighting device as recited in claim 5, wherein the third reflector region extends around an entire periphery of the second reflector region.

7. A lighting device as recited in claim 5, wherein the first reflector region reflects light in 360 degrees relative to an axis of light emission of the light source.

8. A lighting device as recited in claim 5, wherein light directed anywhere within a region defined by a perimeter of the second reflector region is incident upon at least one of the first reflector region and the second reflector region.

9. A lighting device, comprising:

at least one light source, at least one reflector and at least one bridge, the reflector comprising at least a first reflector region, a second reflector region and a third reflector region, the light source on the bridge, the first reflector region and at least a portion of the second reflector region located to a first side of a plane of emission of the light source, the third reflector region located to a second side of the plane of emission of the light source, the bridge directly attached to the third reflector region, the reflector comprising reflecting means for reflecting at least 5% of all light reflected by the first reflector region directly to the third reflector region.

10. A lighting device as recited in claim 9, wherein the first reflector region reflects light in 360 degrees relative to an axis of light emission of the light source.

11. A lighting device, comprising:

at least one light source, at least one reflector and at least one bridge, the reflector comprising at least a first reflector region, a second reflector region and a third reflector region, the light source on the bridge, the first reflector region and at least a portion of the second reflector region located to a first side of a plane of emission of the light source, the third reflector region located to a second side of the plane of emission of the light source, the bridge directly attached to the third reflector region, the reflector comprising reflecting means for reflecting light such that at least 5% of all light reflected by the third reflector region traveled directly from the first reflector region to the third reflector region.

12. A lighting device as recited in claim 11, wherein the first reflector region reflects light in 360 degrees relative to an axis of light emission of the light source.

13. A lighting device, comprising:

at least one reflector and at least one bridge, the reflector comprising at least a first reflector region, a second reflector region and a third reflector region, the bridge directly attached to the third reflector region, the first reflector region having a substantially circular cross-section in any plane that passes through the first reflector region and that is perpendicular to an axis of the reflector, wherein:

the first reflector region has a first reflector region first point along the axis of the lighting device, the first reflector region has a first reflector region extremity, remote from the first reflector region first point, that abuts a first extremity of the second reflector region, the second reflector region has a second reflector region second extremity, remote from the second reflector region first extremity, that abuts a first extremity of the third reflector region, the third reflector region has a third reflector region edge remote from the first extremity of the third reflector region, the first reflector region, the second reflector region and the third reflector region together define an entirety of a concave surface, at least a portion of light emitted from a first location along the bridge is reflected by the first reflector region and then by the third reflector region, and at least a portion of light emitted from a second location along the bridge is reflected by the second reflector region and forms a primary beam of light exiting the lighting device, points on the first reflector region are spaced, in respective directions that are perpendicular to the axis of the lighting device, from respective points on the axis of the lighting device, by respective distances that are larger the farther the respective point on the axis of the lighting device is spaced from a plane defined by the third reflector region edge, points on the second reflector region are spaced, in respective directions that are perpendicular to the axis of the lighting device, from respective points on the axis of the lighting device, by respective distances that are smaller the farther the respective point on the axis of the lighting device is spaced from said plane defined by the third reflector region edge, and points on the third reflector region are spaced, in respective directions that are perpendicular to the axis of the lighting device, from respective points on the axis of the lighting device, by respective distances that are smaller the farther the respective point on the axis of the lighting device is spaced from said plane defined by the third reflector region edge.

14. A lighting device, comprising:

at least one reflector, at least one light source, and at least one bridge, the reflector comprising at least a first reflector region, a second reflector region and a third reflector region, the light source on the bridge, the first reflector region and at least a portion of the second reflector region located to a first side of a plane of emission of the light source, the third reflector region located to a second side of the plane of emission of the light source, the bridge directly attached to the third reflector region, the first reflector region having a substantially circular cross-section in any plane that passes through the first reflector region and that is perpendicular to an axis of the lighting device.

15. A lighting device as recited in claim 14, wherein the first reflector region, the second reflector region and the third reflector region are each substantially radially symmetrical relative to an axis of the lighting device.

16. A lighting device, comprising:

at least a first light source, at least one reflector and at least one bridge, the reflector comprising at least a first reflector region, a second reflector region and a third reflector region, the first reflector region having a substantially circular cross-section in any plane that passes through the first reflector region and that is perpendicular to an axis of emission of the first light source, the first light source on the bridge, the first reflector region and at least a portion of the second reflector region located to a first side of a plane of emission of the light source, the third reflector region located to a second side of the plane of emission of the light source, the bridge directly attached to the third reflector region.

17. A lighting device as recited in claim 16, wherein the first reflector region, the second reflector region and the third reflector region are each substantially radially symmetrical relative to an axis of emission of the light source.

18. A lighting device, comprising:

at least one light source, at least one reflector and at least one bridge, the reflector comprising at least a first reflector region, a second reflector region and a third reflector region, the light source on the bridge, the first reflector region and at least a portion of the second reflector region located to a first side of a plane of emission of the light source, the third reflector region located to a second side of the plane of emission of the light source, the bridge directly attached to the third reflector region, wherein when the light source is illuminated:

a first portion of light emitted by the light source is reflected by the first reflector region and then by the third reflector region, a second portion of light emitted by the light source is reflected by the second reflector region and forms a primary beam of light exiting the lighting device.

19. A lighting device as recited in claim 18, wherein at least 75% of all light reflected by the first reflector region travels from the first reflector region directly to the third reflector region.

20. A lighting device as recited in claim 19, wherein at least 75% of all light reflected by the third reflector region exits the lighting device directly after being reflected by the third reflector region.

21. A lighting device as recited in claim 18, wherein at least 75% of all light reflected by the third reflector region exits the lighting device directly after being reflected by the third reflector region.

22. A lighting device as recited in claim 18, wherein at least 75% of all light reflected by the second reflector region exits the lighting device directly after being reflected by the second reflector region.

23. A lighting device as recited in claim 18, wherein at least 75% of all light reflected by the second reflector region traveled directly from the light source to the second reflector region.

24. A lighting device as recited in claim 18, wherein at least 75% of all light reflected by the third reflector region traveled directly from the first reflector region to the third reflector region.

25. A lighting device as recited in claim 18, wherein not more than 10% of all light emitted by the light source travels from the light source directly to the third reflector region.

26. A lighting device as recited in claim 18, wherein the light source comprises at least one solid state light emitter.

27. A lighting device as recited in claim 18, wherein the first reflector region has at least one dimension that is at least as large as a largest dimension of the light source.

28. A lighting device as recited in claim 18, wherein:

a distance from an axis of light emission of the light source to the first reflector region is larger at a first location than at a second location, and the first location is farther from a plane that passes through the light source and extends substantially perpendicular to the axis of light emission of the light source than the second location is.

29. A lighting device as recited in claim 18, wherein a distance from an axis of light emission of the light source to the second reflector region is smaller at a second reflector region first location than at a second reflector region second location, the second reflector region first location is farther from a plane that passes through the light source and extends substantially perpendicular to the axis of light emission of the light source than the second reflector region second location is.

30. A lighting device as recited in claim 18, wherein a distance from an axis of light emission of the light source to the third reflector region is larger at a third reflector region first location than at a third reflector region second location, the third reflector region first location is farther from a plane that passes through the light source and extends substantially perpendicular to the axis of light emission of the light source than the third reflector region second location is.

31. A lighting device as recited in claim 18, wherein at least 90% of the light emitted by the light source travels directly to one of the first reflector region and the second reflector region.

32. A lighting device as recited in claim 18, wherein the first reflector region, the second reflector region and the third reflector region are all part of a single integral structure.

33. A lighting device as recited in claim 18, wherein an axis of the reflector and an axis of light emission of the light source are co-located.

34. A lighting device as recited in claim 18, wherein the third reflector region extends around an entire periphery of the second reflector region.

35. A lighting device as recited in claim 18, wherein the first reflector region reflects light in 360 degrees relative to an axis of light emission of the light source.

36. A lighting device as recited in claim 18, wherein a surface of the first reflector region and a surface of the second reflector region together fill an entirety of a surface of the reflector which is bounded by a perimeter of the surface of the second reflector region.

37. A lighting device as recited in claim 18, wherein a surface of the first reflector region and a surface of the second reflector region together fill an entirety of a surface of the reflector that is to a first side of a plane defined by an emission surface of the light source.

38. A lighting device as recited in claim 18, wherein light directed anywhere within a region defined by a perimeter of the second reflector region is incident upon at least one of the first reflector region and the second reflector region.

39. A lighting device as recited in claim 18, wherein:

the primary beam of light is of a shape that is of a minimum cross-sectional area, at a first distance from the lighting device, that encompasses at least 75% of the light reflected by the second reflector region, and at least 5% of the first portion of light that is reflected by the third reflector region is within the primary beam of light.

40. A lighting device as recited in claim 18, wherein when the light source is illuminated, at least 5% of all light reflected by the first reflector region travels from the first reflector region directly to the third reflector region.

41. A lighting device as recited in claim 18, wherein when the light source is illuminated, at least 5% of all light reflected by the third reflector region traveled directly from the first reflector region to the third reflector region.

42. A lighting device as recited in claim 18, wherein the first reflector region, the second reflector region and the third reflector region are each substantially radially symmetrical relative to an axis of the lighting device.

43. A lighting device, comprising:

at least one light source, at least one reflector and at least one bridge, the reflector comprising at least a first reflector region, a second reflector region and a third reflector region, the light source on the bridge, the first reflector region and at least a portion of the second reflector region located to a first side of a plane of emission of the light source, the third reflector region located to a second side of the plane of emission of the light source, the bridge directly attached to the third reflector region, wherein locations on the first and second reflector regions together define an entirety of a concave surface.

44. A lighting device as recited in claim 43, wherein:

the primary beam of light of a shape that is of a minimum cross-sectional area, at a first distance from the lighting device, that encompasses at least 75% of the light reflected by the second reflector region, and at least 5% of the first portion of light that is reflected by the third reflector region is within the primary beam of light.

45. A lighting device as recited in claim 43, wherein when the light source is illuminated, at least 5% of all light reflected by the first reflector region travels from the first reflector region directly to the third reflector region.

46. A lighting device as recited in claim 43, wherein when the light source is illuminated, at least 5% of all light reflected by the third reflector region traveled directly from the first reflector region to the third reflector region.

47. A lighting device, comprising:

at least one light source, at least one reflector and at least one bridge, the reflector comprising at least a first reflector region, a second reflector region and a third reflector region, the light source on the bridge, the first reflector region and at least a portion of the second reflector region located to a first side of a plane of emission of the light source, the third reflector region located to a second side of the plane of emission of the light source, the bridge directly attached to the third reflector region, wherein the first reflector region and the second reflector region and an emission plane of the light source completely surround a space.

48. A lighting device as recited in claim 47, wherein:

the primary beam of light is of a shape that is of a minimum cross-sectional area, at a first distance from the lighting device, that encompasses at least 75% of the light reflected by the second reflector region, and at least 5% of the first portion of light that is reflected by the third reflector region is within the primary beam of light.

49. A lighting device as recited in claim 47, wherein when the light source is illuminated, at least 5% of all light reflected by the first reflector region travels from the first reflector region directly to the third reflector region.

50. A lighting device as recited in claim 47, wherein when the light source is illuminated, at least 5% of all light reflected by the third reflector region traveled directly from the first reflector region to the third reflector region.

51. A lighting device, comprising:

at least one reflector and at least one bridge, the reflector comprising at least a first reflector region, a second reflector region and a third reflector region, the bridge directly attached to the third reflector region, the reflector comprising reflecting means for reflecting at least 5% of light reflected by the first reflector region directly to the third reflector region.

52. A lighting device as recited in claim 51, wherein the first reflector region has a substantially circular cross-section in any plane that passes through the first reflector region and that is perpendicular to an axis of the lighting device.

* * * * *